US008291852B1

(12) United States Patent
Cameron et al.

(10) Patent No.: US 8,291,852 B1
(45) Date of Patent: Oct. 23, 2012

(54) DEVICE FOR DEPLOYING AND STORING A FLAG

(76) Inventors: Christopher J. Cameron, Cohoes, NY (US); Anthony Rocco Paniccia, Endicott, NY (US)

( * ) Notice: Subject to any disclaimer, the term of this patent is extended or adjusted under 35 U.S.C. 154(b) by 262 days.

(21) Appl. No.: 12/798,212

(22) Filed: Mar. 31, 2010

Related U.S. Application Data

(63) Continuation-in-part of application No. 12/275,797, filed on Nov. 21, 2008, now abandoned.

(51) Int. Cl.
*G09F 17/00* (2006.01)

(52) U.S. Cl. ..... 116/173

(58) Field of Classification Search ..... 116/173–175; 33/722, 725, 729, 730; D10/109.1, 109.2, D10/111, 114.9; D11/165, 166, 181
See application file for complete search history.

(56) References Cited

U.S. PATENT DOCUMENTS

| | | | | |
|---|---|---|---|---|
| 2,452,842 | A | 11/1948 | Davis | |
| 3,041,730 | A | 7/1962 | Feigin | |
| 3,587,520 | A | 6/1971 | Miller | |
| 3,675,616 | A | 7/1972 | McInnis | |
| 4,055,840 | A | 10/1977 | Uchytil et al. | |
| 4,332,210 | A * | 6/1982 | Lambert | 116/173 |
| 4,800,834 | A | 1/1989 | Feng | |
| 4,896,623 | A | 1/1990 | Seibert et al. | |
| 4,944,656 | A | 7/1990 | Feng et al. | |
| 4,977,849 | A | 12/1990 | Brinton | |
| 5,005,512 | A * | 4/1991 | Fu | 116/173 |
| 5,042,419 | A | 8/1991 | Bianco | |
| 5,287,255 | A * | 2/1994 | Strodtman | 362/102 |
| 5,343,825 | A | 9/1994 | Gazecimeon et al. | |
| 5,642,931 | A * | 7/1997 | Gappelberg | 362/186 |
| 6,009,649 | A | 1/2000 | Bianchi | |
| 6,155,197 | A | 12/2000 | Stanley | |
| 6,553,929 | B1 | 4/2003 | Harp | |
| 6,736,695 | B1 * | 5/2004 | Hoch | 446/397 |
| 6,817,922 | B1 * | 11/2004 | Davies | 446/418 |
| 6,883,459 | B2 | 4/2005 | Maki | |
| D530,647 | S * | 10/2006 | McRoy | D11/181 |
| 7,428,792 | B2 | 9/2008 | Kochan et al. | |
| 7,469,705 | B1 * | 12/2008 | Nocella, III | 135/16 |
| 7,942,108 | B2 * | 5/2011 | Sherrod | 116/173 |
| 2003/0200683 | A1 * | 10/2003 | Gailen | 40/586 |
| 2006/0128254 | A1 * | 6/2006 | Hoch | 446/73 |
| 2006/0154754 | A1 | 7/2006 | Castro | |
| 2008/0149018 | A1 * | 6/2008 | Sherrod | 116/173 |
| 2010/0141438 | A1 * | 6/2010 | Black | 340/540 |
| 2010/0271815 | A1 * | 10/2010 | Gomez | 362/184 |

* cited by examiner

*Primary Examiner* — R. A. Smith
(74) *Attorney, Agent, or Firm* — Maxine L. Barasch; Keohane & D'Alessandro PLLC

(57) ABSTRACT

A device for selectively stowing a flag in a coiled condition and displaying the flag in an unfurled condition. The flag may be affixed to a pole. The device comprises a hollow cylindrical member which encloses the flag and pole. The pole may be captively retained to the hollow cylinder. An illuminable light source may be formed as part of the device. The device may visually simulate sports equipment such as a baseball bat, hockey stick, golf club, and others. The device may have a symbolic object such as a ball, hockey puck, or object symbolic of automobile racing such as an engine fluid dipstick removably affixed thereto. The device may be a toy or souvenir in some embodiments.

36 Claims, 8 Drawing Sheets

DEVICE FOR DEPLOYING AND STORING A FLAG

REFERENCE TO RELATED APPLICATION

This application is a continuation-in-part from, and claims priority of U.S. patent application Ser. No. 12/275,797, filed Nov. 21, 2008 now abandoned. The aforementioned U.S. patent application is hereby incorporated by reference in its entirety.

FIELD OF THE INVENTION

The present invention relates generally to flag deploying and storage devices and, more specifically, to a container that stores and deploys a flag on an extendible pole.

BACKGROUND OF THE INVENTION

Flags of various sizes are frequently flown from a pole. The pole allows for the flag to be held away from a body and unfurl in a manner where the flag may be displayed.

A pole to hold a flag may be hand-held, attached to a building, vehicle or other inanimate object, sunk in the ground, or any other customary means for holding a pole.

Flags may attach and detach from poles and can be folded separately for storage. Flags may be more permanently secured to a pole and are wound around the pole for storage.

A need exists for an apparatus and system for storing a flag on an extendible pole that can be used for deploying the flag, and wherein the apparatus and system are configured to convey enthusiasm or affiliation with a particular activity, sport, team or sporting event.

SUMMARY OF THE INVENTION

The present invention includes a first aspect that provides a device for deploying and storing a flag comprising: an elongate pole comprising a second end and a first end; a flag attached to the elongate pole; and a hollow cylinder comprising a second end and a first end configured to receive the flag and second end of the elongate pole at the first end of the hollow cylinder.

The present invention includes a second aspect that provides a flag deployment and storage system comprising: a system for deploying a flag, wherein the flag is deployed by an elongate pole comprising a second end and a first end and wherein the flag is attached to the elongate pole; and a system for storing a flag, wherein the flag is stored in a hollow generally cylindrical member having a second end and a first end configured to receive the flag and second end of the elongate pole at the first end of the hollow generally cylindrical member.

The present invention includes a third aspect that provides a method for deploying and storing a flag comprising: deploying a flag, wherein the flag is attached to an elongate pole and wherein the elongate pole has a second end and first end; and storing a flag, wherein the flag is stored in a hollow generally cylindrical member having a second end and a first end configured to receive the flag and second end of the elongate pole at the first end of the hollow generally cylindrical member.

The present invention includes a fourth aspect that provides a device for displaying a flag in a deployed mode and storing a flag in storage, or stowed, mode, which may include structural characteristics representative of sporting equipment.

In still another aspect of the invention, the device for displaying a flag may comprise a removable symbolic object.

In yet another aspect of the invention, the device for displaying a flag may comprise indicia conveying enthusiasm for a particular sport, team, or event, etc.

In still another aspect of the invention, the device for displaying a flag may comprise an illuminable light source.

The illustrative aspects of the present invention are designed to address at least one of the problems herein described and other problems not discussed.

BRIEF DESCRIPTION OF THE DRAWINGS

These and other features of this invention will be more readily understood from the following detailed description of the various aspects of the invention taken in conjunction with the accompanying drawings in which.

Figure 1A:
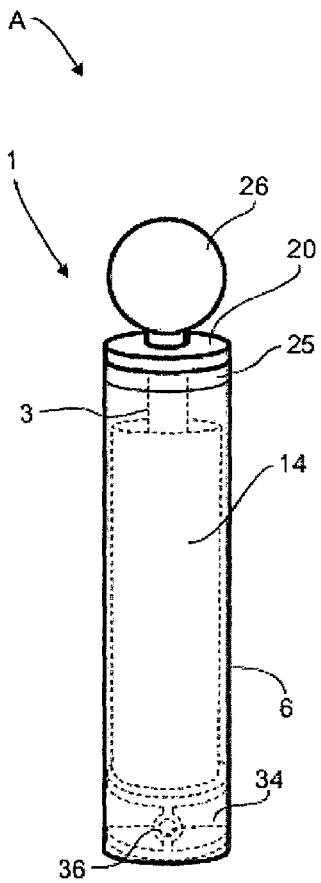
FIG. 1A depicts a view of a device in accordance with one embodiment of the present invention, shown in the storage mode.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION OF THE INVENTION

The present invention provides a device for deploying and storing a flag. Specifically, under the present invention, a flag is attached to an elongate pole, the elongate pole and flag fits into a hollow, generally cylindrical member, and the flag is deployed by extending the elongate pole from the hollow, generally cylindrical member. Embodiments A-E of the invention are described herein. It will be understood that each embodiment is la labeled for ease of disclosure, and that all principles and features are interchangeable throughout each of the embodiments and not limited to those shown on each.

Figure 1B:
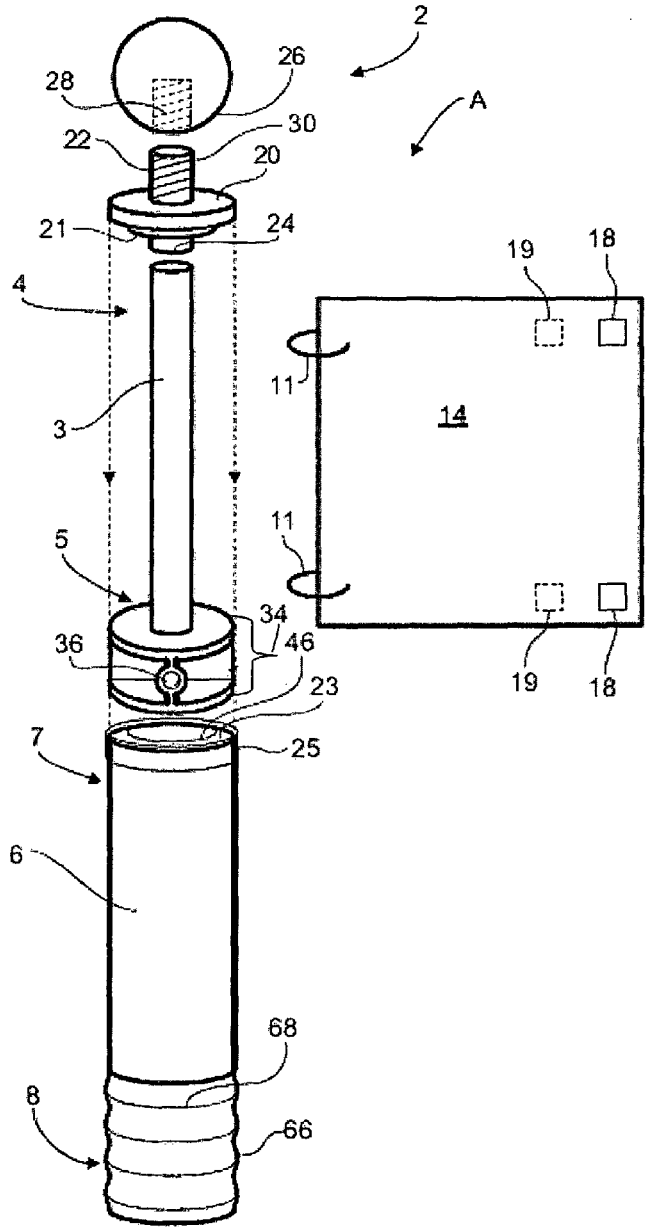
FIG. 1B is an exploded view of the device of FIG. 1A.

Referring first to FIGS. 1A and 1B, the present invention (Embodiment "A") is depicted in storage mode 1 and its various parts in an exploded view 2. The present invention is comprised of an elongate pole 3 having a first end 4 and a second end 5 and a hollow generally cylindrical member 6 having a first end 7 and a second end 8. The second end 8 of the hollow generally cylindrical member 6 may be closed or open.

Figure 2:
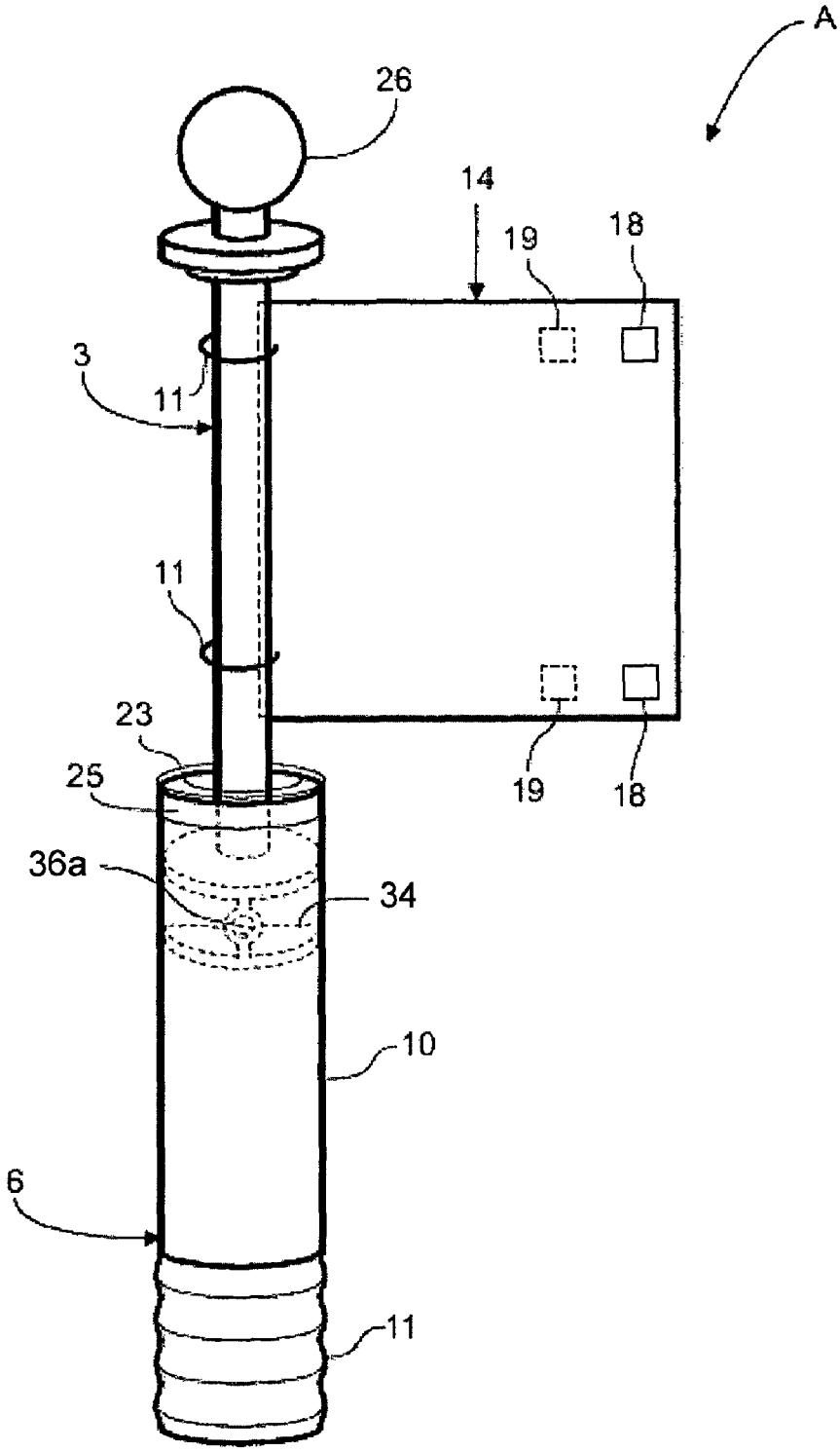
FIG. 2 depicts a view of the device of FIG. 1A in accordance with one embodiment of the present invention, shown in the deployed mode.

Now referring to FIG. 2, the display device A comprises a flag 14 being affixed to the elongate pole 3 such that the flag 14 may be waved from the elongate pole 3 when the flag 14 is unfurled. Flag 14 may be affixed to elongate pole by conventional means such as tied by string (reference numerals 11), glued, or stapled, etc. FIG. 2 illustrates the deployed condition, wherein the flag 14 is fully revealed. In the stowed condition illustrated in FIG. 1A, the flag 14 is received within a hollow, generally cylindrical member 6 which is disposed to enclose the elongated pole 3 and the flag 14. In storage mode 1, the flag 14 may be wrapped around the elongate pole 3 (as shown in FIG. 1A) or alternatively stored inside the elongate pole 3 (not shown). The hollow, generally cylindrical member 6 is configured to enable the elongate pole 3 and the flag 14 to project captively from the hollow, generally cylindrical member 6. Alternatively stated, structure is provided to entrap the elongate pole 3 within the hollow, generally cylindrical member 6 to prevent loss of the elongate pole 3. A person skilled in the art will recognize that providing a slot (not shown) in the elongate pole 3 would permit the flag 14 to be deployed from inside the elongate pole 3.

The invention may comprise closing means for holding flag 14 wrapped around elongate pole 3 in storage mode. Means for closing may be, for example without limitation, hook and loop mechanisms 18 and 19 (or "Velcro®), respectively. As shown in FIGS. 1B and 2, hook mechanisms 18 may be disposed on one side of flag 14 and loop mechanisms 19 may be disposed on the other. The functionality of hook and loop mechanisms is believed to be well known to those of skill in the art and is not further described herein. It will be recognized that other various closing means could be substituted for hook and loop, such as string to be tied around the wrapped flag 14 or rubber bands, elastic bands, snaps, hook and eye mechanisms, etc. (alternatives to the hook and loop mechanisms 18 and 19 are not shown), all of which are known to those of skill in the art. All such closing means are included within the scope of the invention.

In one embodiment, the inventive device may comprise a member 20 which, in storage mode, terminates the upper end of the elongate pole 3. The member 20 may be a generally circular (about the x-axis, as depicted in FIG. 1B) piece which has attached on one side a member 22 for engaging object 26 (described in further detail herein below). On its other side, member 20 has a lower member 21 which has a diameter of a size to fit into an opening 46 formed in the rim 23 of a cap 25 in storage mode. The cap 25 may connect to the upper end 7 of the generally cylindrical member 6 to provide a shoulder which entraps the elongate pole 3 within the generally cylindrical member 6 by establishing interference. The lower member 21 may be utilized to close off first end 7 of generally cylindrical member 6 when the member 20 is fully installed, as would be typical in storage mode 1. Cap 25 is discussed further herein below. As best shown in FIG. 1B, lower member 21 typically has an attachment piece 24 on its underside to engage elongate pole 3, typically by gluing, but also alternatively by frictional engagement, male/female thread apparatuses, or welding, etc.

In one embodiment, a symbolic object 26, typically visually representative of a ball or other second item of sports equipment is affixed to attachment piece 22. The thematic content of the symbolic object 26 will obviously be changed to reflect the thematic content of the display device A, as the display device A may be thematically linked to different sports or non-sports activities, as desired.

Figure 3A:
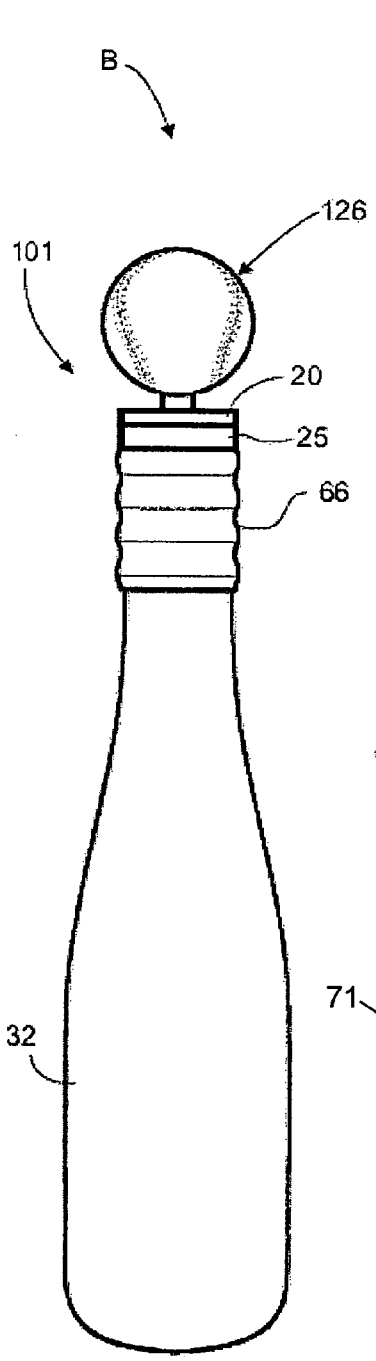
FIG. 3A is a side elevational view of a display device according to a second embodiment of the invention, illustrating the display device in storage mode, or stowed condition ("stowed" and "storage" are used herein interchangeably), and illustrating the aspect of visual representation of a sports activity, namely, baseball.
Figure 3B:
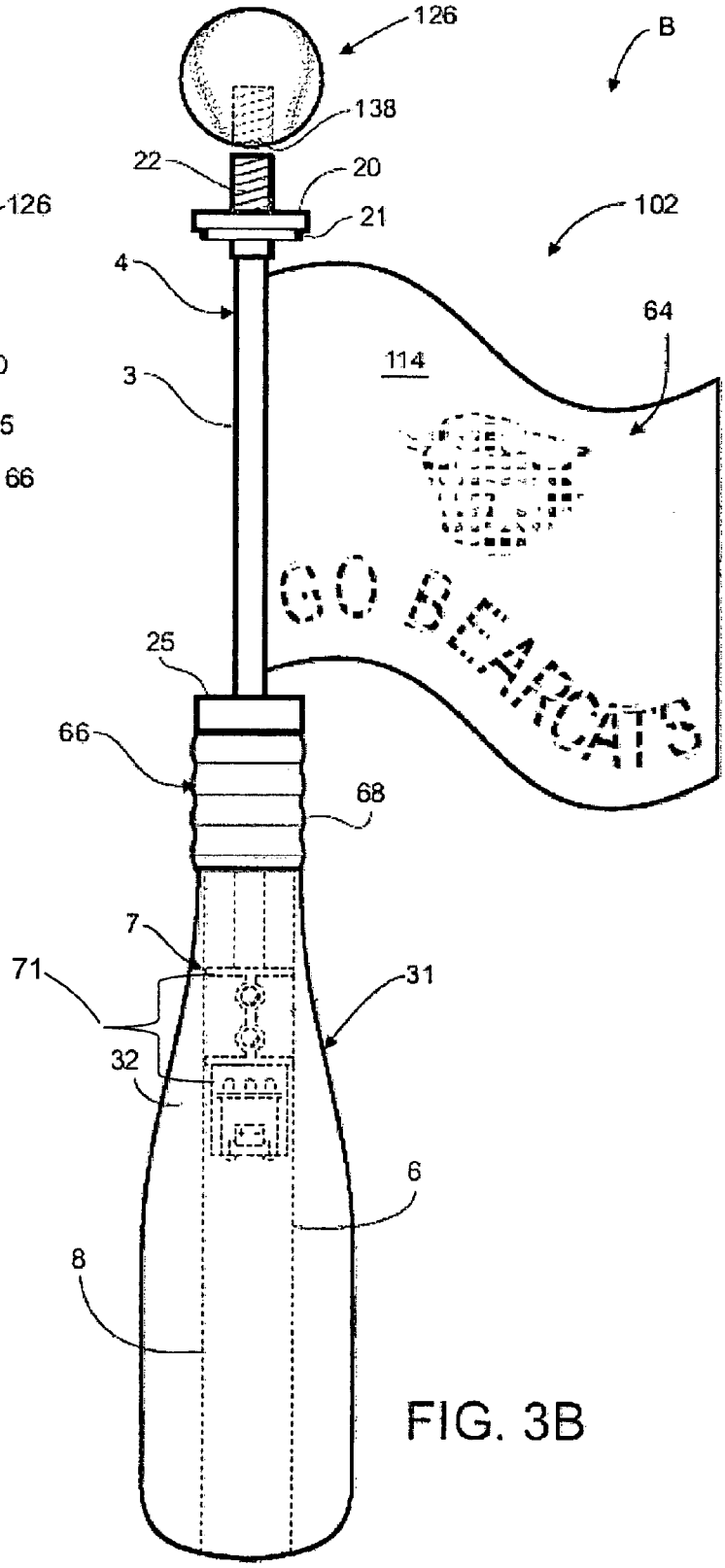
FIG. 3B is an exploded view of the device of FIG. 3A showing a side elevational view of the display device of FIG. 3A, illustrating the display device in a deployed condition, and with a removable component removed.

The symbolic object 26 may be a ball, for example, a baseball 126 as shown in FIGS. 3A and 3B. For the purposes of this disclosure, the term "baseball" will be understood to encompass both baseball per se and also softball. The symbolic object 26 and attachment piece 22 (or others described herein below) may comprise fastening means, shown here as a threaded socket 28 which is matingly compatible with male threads 30 formed on attachment piece 22. It will be recognized that, in one embodiment, male threads 30 could optionally be formed on elongate pole 3, thereby partially eliminating the need for member 20. It will be further recognized that other means for removably fastening the symbolic object may be used, for example, frictional engagement, glue, etc. Therefore, the invention is not limited to using a threaded socket to attach symbolic object 26, and all means for fastening are included within the scope of the invention. Thus, the symbolic object 26 may be removably affixed to the display device A, and may, for example, without limitation, be utilized as a toy ball when removed from the display device A. Symbolic object 26 may be made from a variety of materials, for example, plastic, rubber, etc.

Referring now to FIGS. 3A and 3B, there is shown an embodiment of the invention which has a secondary wall 31, shown in storage mode 101 and deployed mode 102 (referred to herein as Embodiment "B"). The secondary wall 31 is provided to impart a visual effect to the generally cylindrical member 6. In the example of FIGS. 3A and 3B, the secondary wall 31 has an exterior surface 32 comprising external visual characteristics that may simulate an article of sports equipment, for example, without limitation, a baseball bat. It will be recognized that device B may have all of the same components of device A and may also include other components. Therefore, several reference numbers from device A have been carried over to device B. It will be further recognized that various other types of sporting equipment may be simulated by exterior surface 32, and the invention is not limited to those shown for purposes of disclosure.

Figure 4:
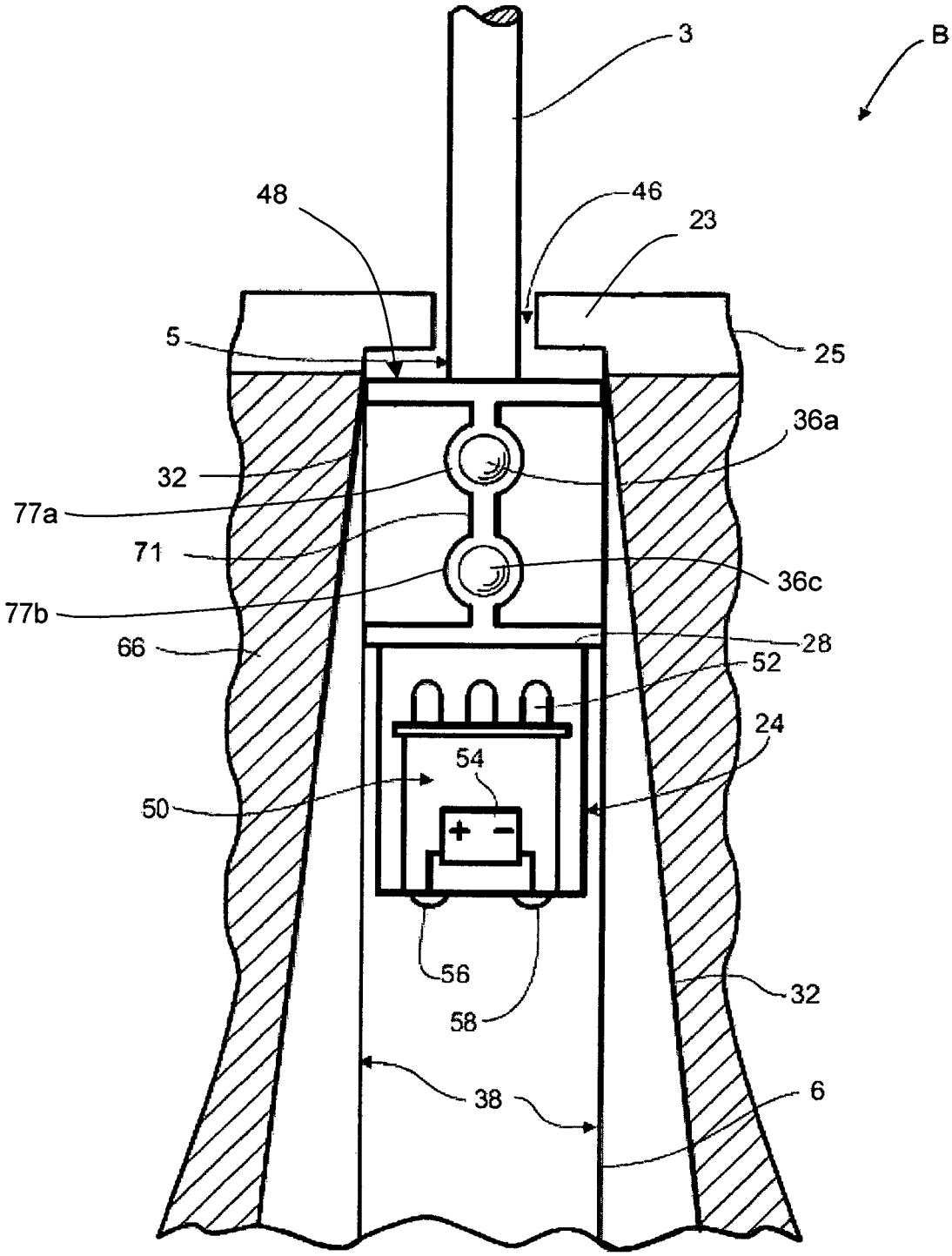
FIG. 4 shows a detailed partial view of an embodiment of an internal mechanism of the inventive device of FIGS. 3A and 3B.
Figure 9:
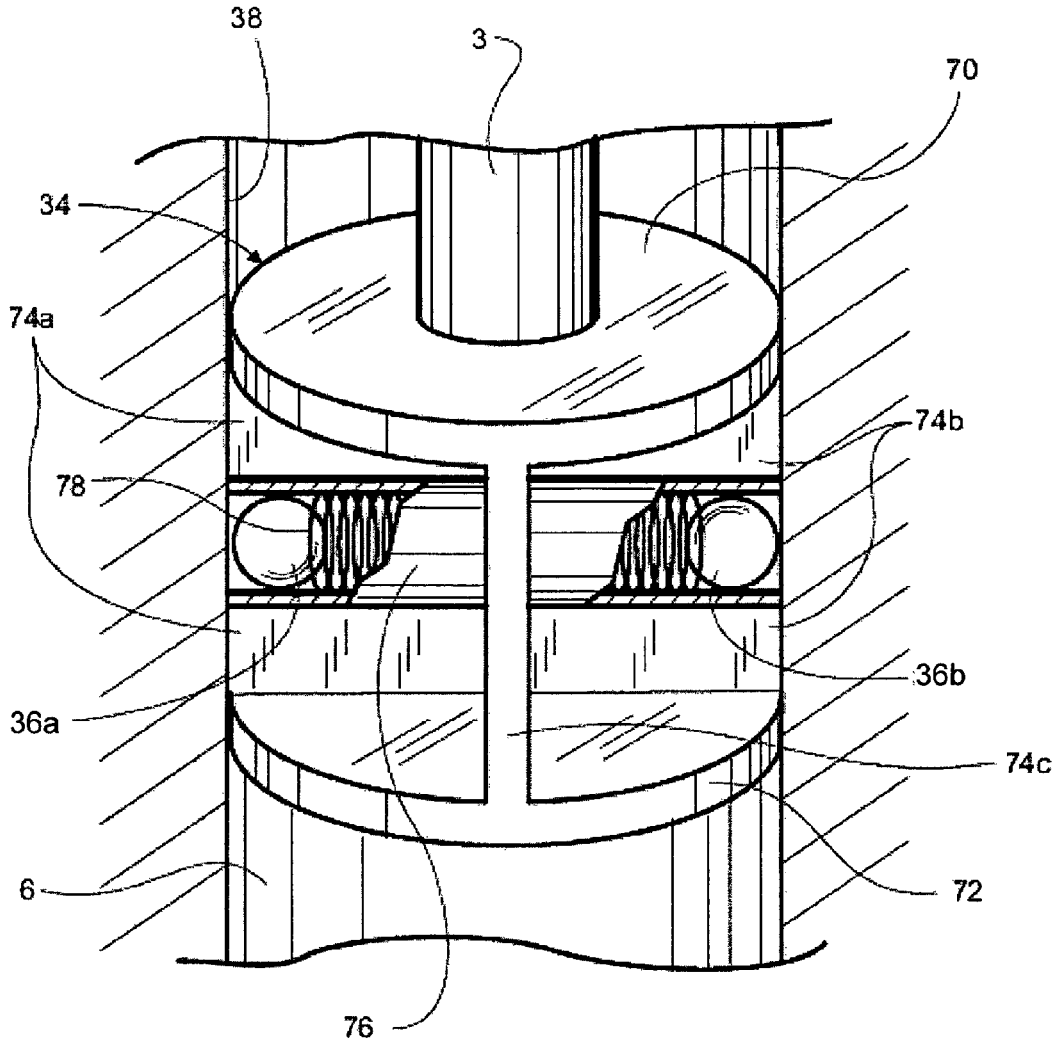
FIG. 9 shows a partial cutaway view of an embodiment of the internal mechanism of a ball bearing apparatus in accordance with the present invention.

In one embodiment, referring again to FIG. 1B, attached to second end 5 of elongate pole 3, disposed inside generally cylindrical member 6, there may be an enlarged head 34 which may comprise a ball bearing apparatus to engage enlarged head 34 with the interior wall 38 (FIG. 4) of generally cylindrical member 6. In one embodiment, as can be best seen in FIG. 9, enlarged head 34 may have an upper horizontal member 70, lower horizontal member 72, and vertical reinforcing ribs or members 74*a*, 74*b*, and 74*c* positioned to support hollow tube 76 relative to the upper horizontal member 70 and the lower horizontal member 72. Additional reinforcing ribs (not shown) corresponding to the vertical members 74*c* may be provided. Inside tube 76 are two balls 36*a* and 36*b* with a spring 78 disposed in between them. The spring 78 creates tension between balls 36*a* and 36*b*, causing the balls 36*a* and 36*b* to engage the interior surface 38 of generally cylindrical member 6 in the manner of ball bearings, thereby holding the enlarged head 34 in place. With manual force applied to the elongate pole 3, such as to expose the flag 14 for display or to return the elongate pole 3 to the stowed position, the balls 36*a* and 36*b* will allow the enlarged head 34 to slide up and down interior surface 38 of generally cylindrical member 6, from storage mode to deployed mode. It will be recognized that more than one pair of balls 36*a* and 36*b* may be used on the ball bearing apparatus, for example, without limitation, four as shown on enlarged head 71 in FIGS. 4 and 5. In FIG. 4, it can be seen that, in one embodiment, there are two balls 36*a* and 36*c* exposed on enlarged head 71. On enlarged head 71, 180 degrees from balls 36*a* and 36*c* are ball 36*b* and a fourth ball (not shown in FIG. 4), respectively. Each pair is situated within a tube (balls 36*a* and 36*b* (not shown) in tube 77*a*, and ball 36*c* and the fourth ball (not shown) in tube 77*b*. Each ball is separated from the other ball in the pair by a spring (not shown) in the same way balls 36*a* and 36*b* are shown separated from one another in the embodiment shown in FIG. 9. It will be recognized that various other mechanisms can be used other than ball bearings to slidably engage enlarged head 34 or 71 with generally cylindrical member 6, and the invention is not limited to the ball bearing apparatus shown. The invention includes all other mechanisms which may be substituted, and known to those of skill in the art.

Turning to FIG. 4, in one embodiment, as described earlier herein, the hollow cylindrical member 6 may comprise a cap 25 attached to its first end 7. The cap 25 may bear an opening 46 for passing the elongate pole 3 therethrough to enable the elongate pole 3 to project from the hollow generally cylindrical member 6 (as seen in FIG. 3B). A rim 23 of cap 25 operates by interference with the upper surface 48 of an enlarged head 71 (or alternatively enlarged head 34) formed in the elongate pole 3 to prevent enlarged head from escaping generally cylindrical member 6. Cap 25 frictionally engages an outer surface of generally cylindrical member 6, but alternatively could be glued on or screwed on with male/female threading apparatus known to those of skill in the art.

In one embodiment, the enlarged head 71 (or alternatively enlarged head 34) may carry a lamp assembly 50 comprising a light source such as one or more light emitting diodes (LEDs) 52 (only one of the LEDs is called out by reference number 52, although other similar LEDs may be provided). A battery 54 and a switch comprising operating pushbuttons 56, 58 complete the electrical power circuit serving the LEDs 52. The switch may be arranged such that depressing one pushbutton 56 illuminates the LEDs 52, while the other pushbutton 58 extinguishes the LEDs 52, for example. Of course, any other switching structure and arrangement may be provided as desired. The light source may be an incandescent lamp or of any other type if desired. It will be recognized that the invention is not limited to carrying the light source on the enlarged head, and that the light source may be disposed anywhere feasible on the inventive device.

Figure 5:
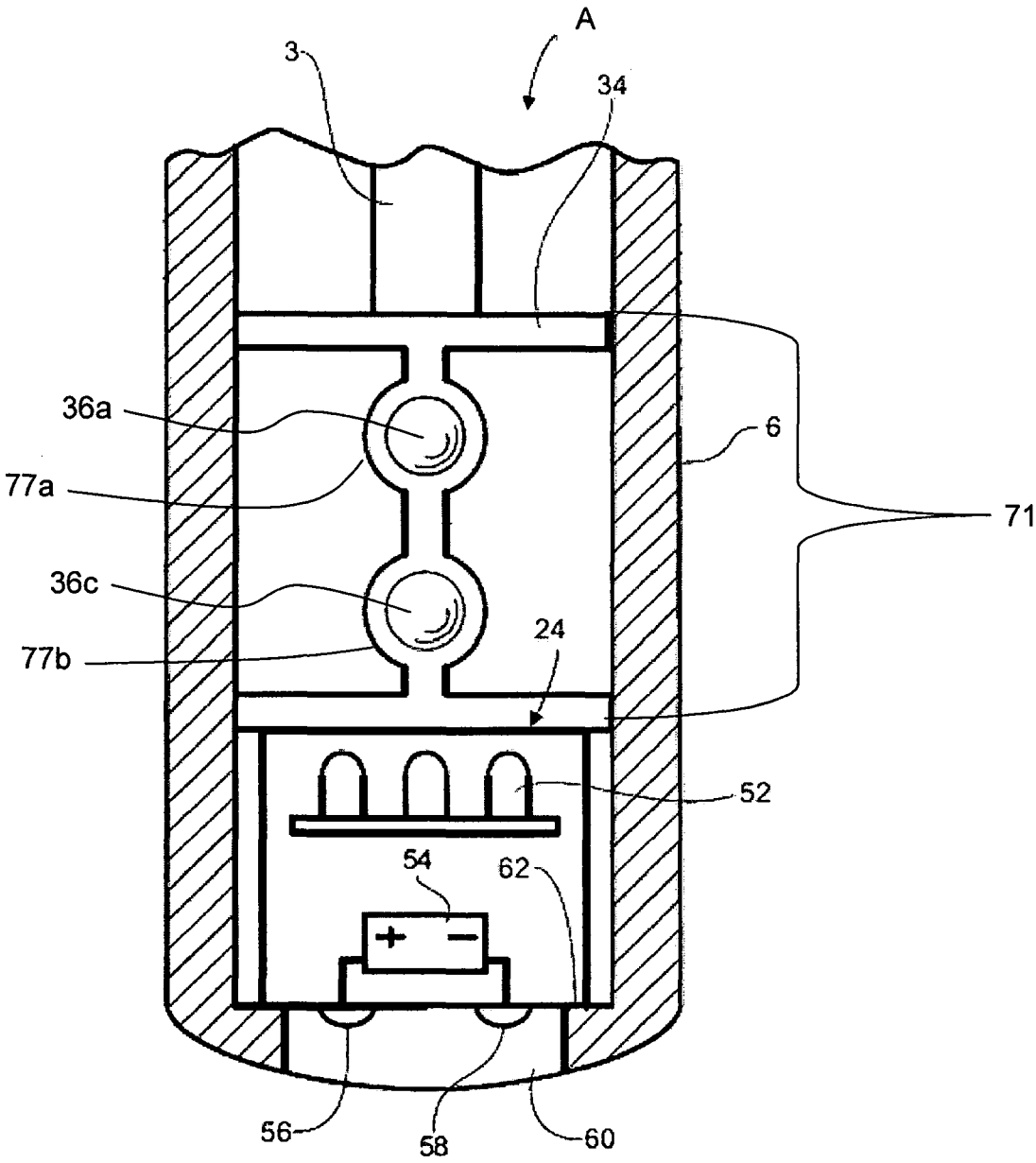
FIG. 5 shows a detailed partial view of an embodiment of an internal mechanism of the inventive device.

Referring now to FIG. 5, in one embodiment, the hollow generally cylindrical member 6 of device B may also comprise a light assembly 50. In one embodiment, the bottom of hollow generally cylindrical member 6 may be configured to include an opening 60 of diameter less than that of the enlarged head 34. The opening 60 both affords access to the switch elements, represented as operating pushbuttons 56 and 58, and also forms a shoulder 62 which interferes with the enlarged head 71 (or 34), thereby preventing the elongate pole 3 from falling out through the bottom of the hollow generally cylindrical member 6 and becoming lost. It will be appreciated that the term "bottom" refers only to the inventive device as depicted herein. Obviously, a display device such as the display devices A and B may be held in any selected orientation, so that the display devices A and B do not have true bottoms.

Referring again to FIG. 3B, in one embodiment, the invention could comprise a flag 14 having indicia 64 for conveying a message of enthusiasm for and representing a particular team, activity, sporting event, person, company, product, and/or service, etc. Indicia 64 may comprise one or more of a graphic, image, wording, design, color scheme, logo, etc. It will be recognized that many other indicia may be substituted for those herein described, and the invention includes within its scope all such indicia falling within the spirit of the invention. In the embodiment shown for purposes of disclosure, indicia 64 indicates enthusiasm for a particular team. Alternatively, or in addition to, indicia 50 shown on the flag, indicia 64 could appear on object 26 (or 126, etc.) and/or exterior surface 10 (FIG. 2) of generally cylindrical member 6 or exterior surface 32 of wall 31. It will be recognized that the invention is not limited to the particular indicia 64 shown for purposes of disclosure, and that it is merely provided as an example, and in no way meant to limit the invention. The inventive device may thereby become a souvenir or toy to be distributed at sports games and the like.

Typically, the inventive device is deployed by a user grasping attached object 26 and manually pulling the elongate pole 3 from generally cylindrical member 6. In one embodiment, there may be means for gripping disposed on an exterior surface 10 of generally cylindrical member 6 (as shown in FIG. 2) or the exterior surface 32 of secondary wall 31 (as shown in FIG. 3B) to assist a user of the device in holding onto the inventive device when pulling elongate pole 3 into deployed mode. Herein means for gripping are shown as a sleeve 66, which may be made of rubber, plastic or any other suitable material known to those of skill in the art. The sleeve 66 may have depressions 68 to allow for ergonomic support of a person's fingers. It will be recognized that sleeve 66 is shown at second end 8 of generally cylindrical member 6 in embodiment A, but it may instead be provided on any part of generally cylindrical member 6, such as, for example, first end 7, like shown in FIGS. 3A, 6 and 7. It will be further recognized that means for gripping may alternatively comprise grooves etched into outer surface 10 (FIG. 2) of generally cylindrical member 6 or exterior surface 32 of secondary wall 31, depressions disposed within generally cylindrical member 6 or secondary wall 32, or a handle (not shown) which projects externally, such as that on a typical coffee cup, etc.

The principles of the display devices A and B may apply to structurally and functionally similar devices adapted to represent sports and activities other than baseball, non-limiting examples of which are described herein below. It will be recognized that devices C through E may comprise the same variety of inner components as those described in embodiments A and B.

Figure 6:
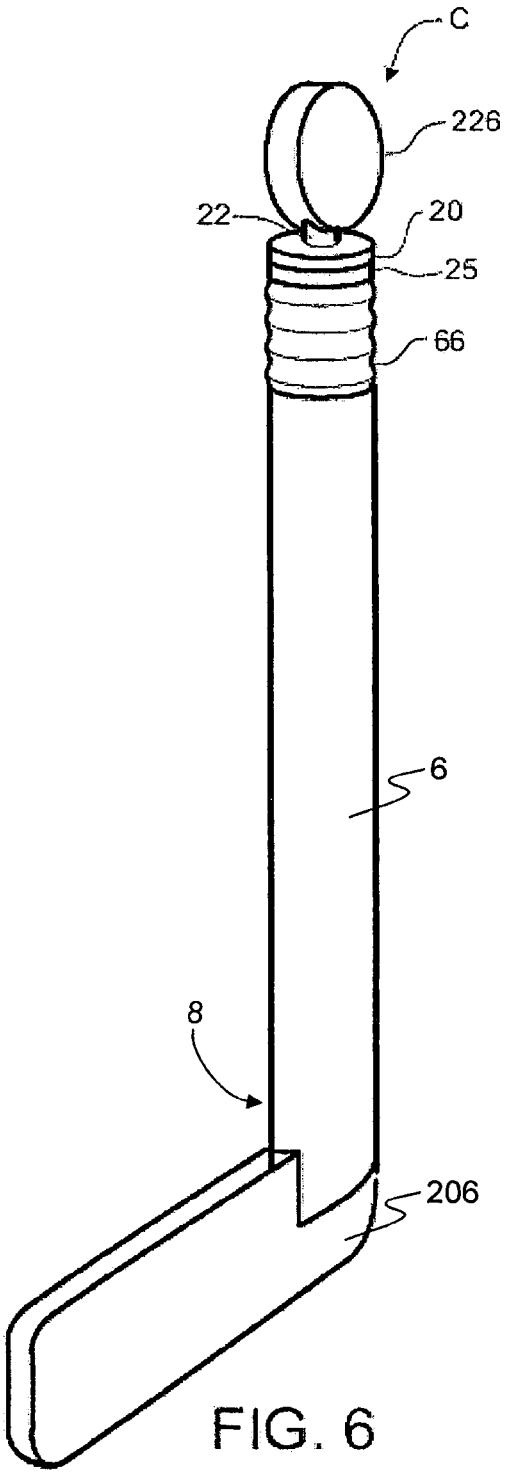
FIG. 6 is a side elevational view of a display device according to at least one further aspect of the invention wherein the activity which is represented is hockey.

As seen in FIG. 6, a display device C may have a hollow generally cylindrical member 6 having a member 206 attached at its second end 8 to make the inventive device visually resemble a hockey stick. Hollow generally cylindrical member 6 and member 206 may be attached by any conventional means, for example, without limitation, by gluing or welding. It will be recognized that alternatively, generally cylindrical member 6 and member 306 could be manufactured as a single piece (and therefore, attaching would not be necessary). A symbolic object 226 may be removably affixed to the display device C in the same way as that of the symbolic object 126 of FIGS. 3A and 3B. The symbolic object 226 may visually resemble a hockey puck. It will be recognized that in this and other embodiments, the generally cylindrical member may have a square, rectangular, triangular, etc. shape, and that the word "cylindrical" is used only for the purposes of disclosure and is not meant to limit the invention.

Figure 7:
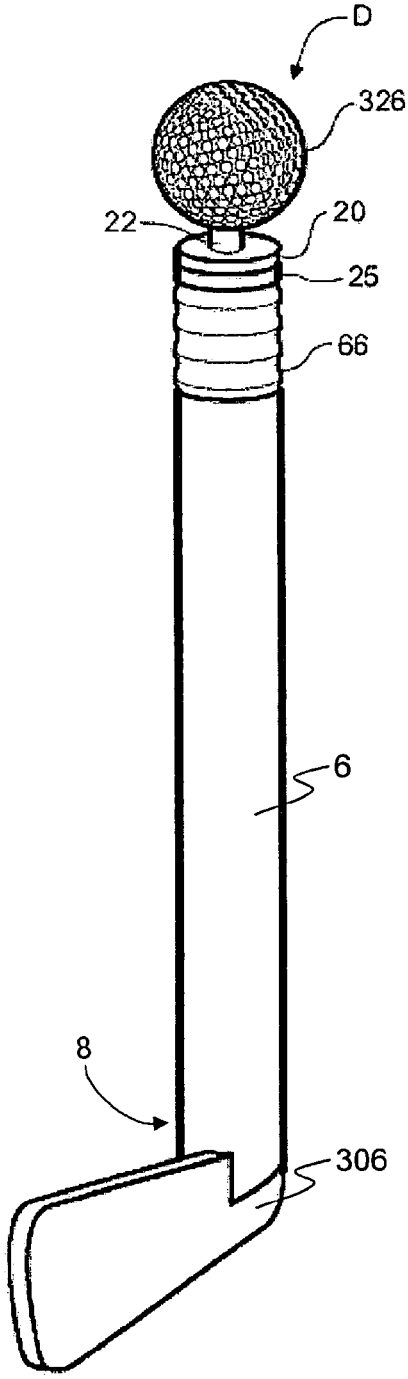
FIG. 7 is a side elevational view of a display device according to at least one further aspect of the invention, wherein the activity which is represented is golf.

FIG. 7 shows a display device D which may be structurally and functionally similar to the display device A, but which generally cylindrical member 6 having a member 306 attached at its second end 8 to make the inventive device visually resemble a golf club. Hollow generally cylindrical member 6 may be attached to member 206 by any conventional means, for example, without limitation, by gluing or welding. It will be recognized that alternatively, generally cylindrical member 6 and member 306 could be manufactured as a single piece (and therefore, attaching would not be necessary). A symbolic object 326 may be removably affixed to the display device D in the same way as that of the symbolic object 126 of FIGS. 3A and 3B. The symbolic object 326 may visually resemble a golf ball. The hollow generally cylindrical member 306 which encloses a flag (not visible in FIG. 7) may be modified to better reflect configuration and proportions of the handle of a golf club.

Figure 8:
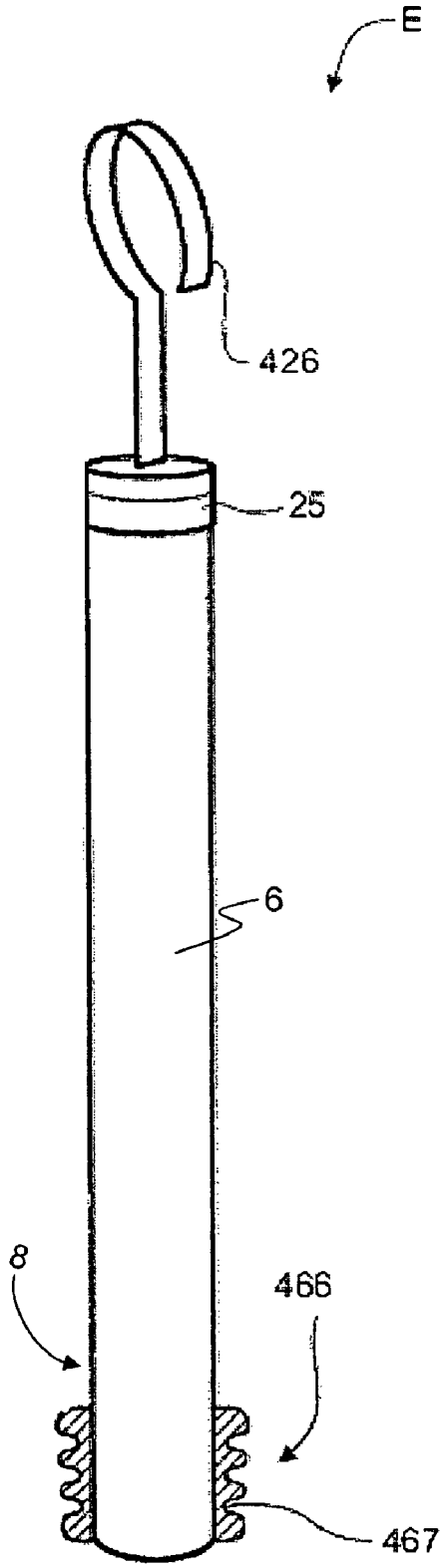
FIG. 8 is a side elevational view of a display device according to still a further aspect of the invention, wherein the activity which is represented is automobile racing.

FIG. 8 shows a display device E which may be structurally and functionally similar to the display device B, but which may be adapted to represent an activity such as automobile racing by incorporating an object associated with an automobile. For example, the symbolic object 426 which may be removably affixed to the display device 406 may visually resemble a handle of an engine fluid dipstick. The hollow generally cylindrical member 6 which encloses a flag (not visible in FIG. 8) is shown having a grip 466 having external circumferential grooves 467 to help accommodate a person's hand.

It will be recognized that the simulated elements of the various display devices shown and described herein may be modified from the specifics of the depictions. For example, without limitation, orientations of the symbolic object 226 may be changed so that the simulated puck of the display device C is turned perpendicularly or otherwise from the orientations shown.

The inventive principles may be applied to other sports such as tennis and badminton, jai alai, basketball, soccer, football, lacrosse, and others by incorporation of equipment and objects representative of those activities. A person skilled in the art will readily recognize that the appearance of the hollow cylindrical member 6 and elongate pole 3 could be varied to represent different social, sporting and other events.

A person skilled in the art will readily recognize the components of the device could be made of a variety of materials. In one embodiment, the components of the inventive device are made from durable plastic having a strong consistency that allows them to resist breaking, cracking, and shattering when dropped. The components of the inventive device may have a variety of color schemes, and in one embodiment, may be clear plastic so the lighting from the LEDs 52 can be seen through the exterior of the walls of the generally cylindrical member 6 and/or secondary wall 31. In one embodiment the flag is made of a substantially absorbent cloth material such as terry cloth.

A person skilled in the art will readily understand that in alternative embodiments, the invention could be operated electronically. Similarly, an electrical device could be powered by stationary or portable power sources.

The foregoing description of the preferred embodiments of this invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of this invention as defined by the accompanying claims.

As used herein, an element or step recited in the singular and proceeded with the word "a" or "an" should be understood as not excluding plural elements or steps, unless such exclusion is explicitly stated. Furthermore, references to "one embodiment" of the present invention are not intended to be interpreted as excluding the existence of additional embodiments that also incorporate the recited features.

Moreover, unless explicitly stated to the contrary, embodiments "comprising" or "having" an element or a plurality of elements having a particular property may include additional such elements not having that property. It will be further recognized that while different reference numbers are sometimes used for interchangeable components of different embodiments of the invention, this is only for the purpose of disclosure, and is not meant to imply any such component is different in any way other than as shown or described from its respective component in another embodiment (for example, without limitation, enlarged heads 34 and 71, and tubes 77*a*, 77*b*, and 76).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A device for deploying and storing a flag, comprising:

an elongate pole comprising a first end and a second end;

a flag attached to the elongate pole;

a hollow generally cylindrical member comprising a second end and a first end wherein the first end is configured to receive the second end of the elongate pole and the flag, and wherein the elongate pole comprises an enlarged head having a ball bearing apparatus disposed therein to engage an interior surface of the generally cylindrical member;

a symbolic object which is visually representative of a sport, and which is removably affixed to the first end of the elongate pole; and a lamp assembly, the lamp assembly comprising a light source, a battery, and a switch disposed to illuminate and extinguish the light source, wherein the lamp assembly is situated within an interior section of the generally cylindrical member and wherein the lamp assembly is attached to the enlarged head.

2. The device of claim 1 wherein the hollow generally cylindrical member comprises an exterior surface comprising external visual characteristics of an article of sports equipment.

3. The device of claim 2, wherein external visual characteristics are selected from the group consisting of: a baseball bat, a hockey stick, a golf club, and an engine fluid dipstick.

4. The device of claim 1, wherein the light source comprises a light emitting diode.

5. The device of claim 1, wherein the symbolic object is selected from the group consisting of a baseball, a football, a golf ball, a soccer ball, and a puck.

6. The device of claim 5, wherein the symbolic object is removably attached to the elongate pole by fastening means.

7. The device of claim 6 wherein the fastening means are selected from the group: threads, frictional engagement, and glue.

8. The device of claim 1, wherein grip is disposed on the generally cylindrical member.

9. The device of claim 1 wherein the elongate pole and the generally cylindrical member are made from durable plastic.

10. The device of claim 1, wherein the flag is comprised of a substantially absorbent cloth material.

11. The device of claim 10, wherein the substantially absorbent cloth material is comprised of terry cloth.

12. The device of claim 1 comprising one or more indicia depicting enthusiasm for at least one of a particular team, activity, sporting event, person, company, product, and/or service.

13. The device of claim 12 wherein said one or more indicia is at least one of a graphic, photo, wording, design, color scheme, and logo.

14. The device of claim 1, further comprising closing means.

15. The device of claim 14 wherein said closing means are selected from the group: hook and loop, string, rubber bands, elastic bands, snaps, and hook and eye mechanisms.

16. The device of claim 1, wherein the generally cylindrical member comprises an opening configured in such a way that a user may access the switch therethrough.

17. The device of claim 16, wherein the generally cylindrical member and the opening are further configured in such a way as to form a shoulder to prevent the elongate pole and the enlarged head from falling out of the opening.

18. The device of claim 1, wherein the generally cylindrical member comprises a substantially clear material such that a light emitted by the light source is visible therethrough.

19. A device for deploying and storing a flag, comprising:

an elongate pole comprising a first end and a second end;

a flag attached to the elongate pole;

a hollow generally cylindrical member comprising a second end and a first end wherein the first end is configured to receive the second end of the elongate pole and the flag, and wherein the elongate pole comprises an enlarged head having a ball bearing apparatus disposed therein to engage an interior surface of the generally cylindrical member;

a symbolic object which is visually representative of a sport, and which is removably affixed to the first end of the elongate pole;

a secondary wall disposed around the generally cylindrical member; and a lamp assembly, the lamp assembly comprising a light source, a battery, and a switch disposed to illuminate and extinguish the light source, wherein the lamp assembly is disposed within an interior section of the generally cylindrical member, and wherein the lamp assembly is attached to the enlarged head.

20. The device of claim 19 wherein the secondary wall comprises an exterior surface comprising external visual characteristics of an article of sports equipment.

21. The device of claim 20, wherein the external visual characteristics are selected from the group consisting of: a baseball bat, a hockey stick, a golf club, and an engine fluid dipstick.

22. The device of claim 19, wherein the light source comprises a light emitting diode.

23. The device of claim 19, wherein the symbolic object is selected from the group consisting of a baseball, a football, a golf ball, a soccer ball, and a puck.

24. The device of claim 19, wherein the symbolic object is removably attached to the elongate pole by fastening means.

25. The device of claim 24 wherein the fastening means are selected from the group: threads, frictional engagement, and glue.

26. The device of claim 19, wherein the apparatus further comprises a grip disposed on the a secondary wall.

27. The device of claim 19 wherein the elongate pole and the generally cylindrical member are made from durable plastic.

28. The device of claim 19, wherein the flag is comprised of a substantially absorbent cloth material.

29. The device of claim 28, wherein the substantially absorbent cloth material is comprised of terry cloth.

30. The device of claim 19 comprising one or more indicia depicting enthusiasm for at least one of a particular team, activity, sporting event, person, company, product, and/or service.

31. The device of claim 30 wherein said one or more indicia is at least one of a graphic, photo, wording, design, color scheme, and logo.

32. The device of claim 19, further comprising closing means.

33. The device of claim 32 wherein said closing means are selected from the group: hook and loop, string, and rubber bands.

34. The device of claim 19, wherein the generally cylindrical member comprises an opening configured in such a way that a user may access the switch therethrough.

35. The device of claim 34, wherein the generally cylindrical member and the opening are further configured in such a way as to form a shoulder to prevent the elongate pole and the enlarged head from falling out of the opening.

36. The device of claim 19, wherein the generally cylindrical member and secondary wall each comprises a substantially clear material such that a light emitted by the light source is visible therethrough.

* * * * *